US006425323B1

(12) United States Patent
Steuer

(10) Patent No.: US 6,425,323 B1
(45) Date of Patent: Jul. 30, 2002

(54) METHOD AND APPARATUS FOR DISPOSING OF WEB MATERIAL

(76) Inventor: Armin Steuer, Am Waldrand 30, D-71111 Waldenbuch (DE)

( * ) Notice: Subject to any disclaimer, the term of this patent is extended or adjusted under 35 U.S.C. 154(b) by 0 days.

(21) Appl. No.: 09/400,285

(22) Filed: Sep. 21, 1999

(30) Foreign Application Priority Data

Sep. 23, 1998 (DE) ..... 198 43 533

(51) Int. Cl.[7] ..... B30B 9/00
(52) U.S. Cl. ..... 100/90; 100/155 R; 100/170
(58) Field of Search ..... 100/90, 155 R, 100/170; 493/344, 347, 351, 373

(56) References Cited

U.S. PATENT DOCUMENTS

| | | | | | |
|---|---|---|---|---|---|
| 3,416,414 | A | * | 12/1968 | Smithe | 109/1 S |
| 3,923,575 | A | * | 12/1975 | Wootten | 156/211 |
| 3,969,173 | A | * | 7/1976 | Amberg et al. | 156/183 |
| 4,205,596 | A | * | 6/1980 | Chestnut | 100/170 |
| 4,385,479 | A | | 5/1983 | Focke | 53/389 |
| 4,413,984 | A | * | 11/1983 | Alter | 493/222 |
| 4,451,249 | A | * | 5/1984 | deBin | 493/196 |
| 4,764,240 | A | * | 8/1988 | Simeone et al. | 156/216 |
| 4,914,997 | A | | 4/1990 | Belvederi | 83/156 |
| 5,062,340 | A | * | 11/1991 | Greven | 156/197 |
| 5,716,312 | A | * | 2/1998 | Kristel | 493/245 |
| 5,976,065 | A | * | 11/1999 | Bellanca | 156/252 |
| 6,022,442 | A | * | 2/2000 | Seidl | 156/256 |

FOREIGN PATENT DOCUMENTS

| | | |
|---|---|---|
| DE | 37 13 666 C2 | 11/1888 |
| DE | 648075 | 1/1935 |
| DE | 77 12 423 | 4/1978 |
| DE | 35 24 305 A1 | 12/1985 |
| DE | 3730810 | 3/1989 |
| DE | 38 40 598 C2 | 6/1990 |
| DE | 4021573 A1 | 2/1991 |
| DE | 41 42 054 A1 | 6/1993 |
| DE | 195 00 991 A1 | 7/1996 |
| EP | 0 718 099 A2 | 6/1996 |
| GB | 2 254 586 A | 10/1992 |
| GB | 2254586 A | 10/1992 |

* cited by examiner

*Primary Examiner*—Allen Ostrager
*Assistant Examiner*—William Hong
(74) *Attorney, Agent, or Firm*—Nath & Associates PLLC; Gary M. Nath; Todd L. Juneau

(57) ABSTRACT

In a method and an apparatus for disposing of thin, flexible material, which is in the form of a material web moved in the web direction and supplied to the disposal apparatus, a front web section at the front in the movement direction is held fast in areal manner by first holding means and a second web section spaced behind the same is held fast in areal manner by second holding means. The web material is separated by a separating device in an exposed and optionally taut intermediate section located between the retained web sections. Even tear-sensitive material can be reliably held by the flat-engaging holding means. The separation of web material held on both sides under the action of a knife or the like can take place in troublefree manner, particularly without drawing in the material. The apparatus can be used with particular advantage for the continuous disposal of used stamping film in hot stamping devices.

34 Claims, 1 Drawing Sheet

METHOD AND APPARATUS FOR DISPOSING OF WEB MATERIAL

BACKGROUND OF THE INVENTION

1. Field of the Invention

The invention relates to a method for the disposal of flexible material, which is in the form of at least one moving material web, which is fed in a feed direction with a feed web speed to a disposal device, particularly for disposing of used stamping film web during the operation of a hot stamping apparatus.

In hot stamping, in a hot stamping apparatus a material layer to be stamped is guided at a constant speed through a stamping gap, which is formed between a stamping cylinder having the stamping tool and a counterpressure or impression element, particularly an impression cylinder. Over the material layer a stamping film web is so concomitantly moved that it is displaced at the same speed as the material layer during a stamping interval. During the stamping interval, stamping material on the stamping film web, e.g. discreet, successive stamping units such as images or texts, or part of a colour layer to be stamped on is transferred to the material layer, under the action of pressure and temperature. Using a suitably constructed conveying mechanism, the stamping film web is drawn off of a preferably roll-like film supply and moved through the stamping gap, whilst the used stamping film is removed and has to be disposed of.

In known hot stamping devices of this type disposal takes place in that the used stamping film web is wound onto a wind-up storage roll. When the roll is full on the waste side, it is necessary to interrupt the stamping process or the feed to the waste roll for roll change purposes. This normally gives rise to machine downtimes reducing the overall stamping efficiency. In addition, on stopping the installation or restarting, malfunctions and/or waste production with respect to the stamped material can arise. In order to avoid such problems a continuous disposal of used web material is sought.

2. Description of Related Art

A stamping apparatus known from GB 2 254 586 has on the waste side a disposal device functioning in the manner of a shredder and which is supplied with the spent web material by means of an upstream conveying station. The latter has two contrarotating transfer rollers, between which the web material is jammed and conveyed through. The free web material end passing out of the conveying mechanism on the discharge side passes into the feed slot of the shredder, which tears the web material into small pieces and conveys same into a storage tank, which is emptied every so often. Particularly in the case of relatively thin, only slightly inherently rigid web material, malfunctions can arise in the cutting mechanism of shredders, e.g. as a result of incomplete tearing of the material or clogging of the cutting mechanism.

The problem of the invention is to avoid the disadvantages of the prior art. In particular, a method and an apparatus are to be provided, which permit a troublefree, continuous disposal of in particular also very thin web material, such as used stamping film web.

BRIEF SUMMARY OF THE INVENTION

In order to solve this problem, the invention proposes a method for the disposal of flexible material in the form of at least one moving material web, the material web being supplied in a feed direction with a feed web speed to a disposal apparatus, the method comprising the following steps:

holding fast a first web section of the material web the second web section being spaced from the first web section;

holding fast a second web section of the material web;

separation of the material web in an intermediate section located between the first web section and the second web section.

In addition, the invention proposes a disposal apparatus for the disposal of flexible material in the form of at least one moving material web, the material web being supplied in a feed direction with a feed web speed to the disposal apparatus, the disposal apparatus comprising:

first holding means for the retention of a first web section of the material web in a retention area;

second holding means for the retention of a second web section of the material web in a retention area, the first holding means being spaced apart from the second holding means;

a separating device cooperating with the holding means for separating of the material web in an intermediate section located between the first web section and the second web section.

DETAILED DESCRIPTION OF THE INVENTION

According to the invention, in the case of a disposal method according to the preamble, a first material web section and a second material web section preferably laterally spaced from the first web section are held fast and that the material web in an intermediate section located between the first and second web sections is separated or cut through for producing web material pieces. The web material pieces can then be collected and optionally undergo further processing steps. As a result of the preferably flat or areal holding fast of the web material on either side of the separating area, it is possible to ensure that during the separation process the web material is not drawn into the separating area, i.e. does not give way to a preferably mechanically acting separating member and instead opposes the same with a resistance facilitating separation. This is particularly advantageous in the case of very thin web material having a limited inherent rigidity, such as e.g. stamping film webs, which have a typical thickness between 10 and 20 $\mu$m. Such stamping film webs provided with a carrier film of tough plastic have a tendency in the cutting mechanisms of conventional shredders, whose cutting mechanisms have cutting rollers in cutting engagement with one another, due to inadequate film tension tend to be not or incompletely separated and/or to clog the cutting mechanisms. As a result of the inventive holding fast of the web material on either side of the separating or intermediate section, the web material is kept under tension in the separating section, which aids an easy, reliable and complete separation.

According to a further development, the web material is separated in an intermediate or separating section freely suspended and/or held taut between the stopped web sections. As a result it is possible to aid a complete separation, because a separating member used for separating purposes can completely pass through the surface area defined by the web material. To attain a reliable separation it is advantageous if the length of the freely suspended intermediate section, i.e. not in contact with a substrate, is kept as short as possible, so as to minimize the deflection aside of the web material during separation aided by the extension elasticity of the web material to be separated. The length of the free intermediate section can correspondingly be less than 1 cm, particularly between approximately 1 and approximately 5 mm.

According to a preferred development, the first web section is at the front in the feed direction and the second web section at the rear in the feed direction and that separation takes place transversely, particularly substantially perpendicular to the feed direction. In the case of this cross-separation normally taking place over the entire material web width, the web portion at the front can be separated and easily disposed of, whereas the rear portion can still be held and can serve as the front portion for the following separation. As a result of the holding fast of the in each case rear web section, it is also ensured that the supplied material web cannot slip out of the disposal device and is instead constantly securely held.

Alternatively or additionally, it is also possible, considered in the feed direction, for the first web section to at least zonally be positioned alongside the second web section and for the separation to take place at an acute angle or substantially parallel to the feed direction. As a result of a longitudinal cut or preferably several parallel, particularly simultaneously performed longitudinal cuts optionally narrow strips of web material can be produced, which can optionally be further shortened by suitable transverse cuts or tears. The resulting strips can remain, after separation, advantageously in areal contact with a conveying mechanism carrying them and can therefore be supplied in an ordered arrangement to further disposal stages.

For the complete separation of the web material it is possible to use various methods, which are preferably adapted to the separating or cutting method for the web material. Particular preference is given to a method in which the web material for complete separation is cut with a free cutter, i.e. with a mechanical separating member, which requires for bringing about the separating action no countermember, such as a counterblade or the like. Corresponding separating devices have a particularly long life and are subject to very little wear, because in particular with web material freely suspended in the separating area a blade only comes into contact with the softer web material. It is also possible to melt the web material in the intermediate area for separation purposes, particularly along a substantially straight melt line. This variant e.g. performable by means of a hot air blower or heated or incandescent wire or the like is particularly suitable for web material with a thermoplastic material. An advantageous variant is characterized in that, for separation, the web material is perforated at numerous, preferably linearly positioned points and preferably simultaneously and the perforations are subsequently enlarged until they coalesce. This method, e.g. performable by means of a pressed-on sawtooth blade is particularly suitable for the separation of plastic sheets, but as a result of the initial punctiform action of a separating member on the sheet web only requires limited forces for producing adequate separating pressures and can be used with particular advantage for taut web material, in which the enlargement of the perforations can in part be assisted by automatically progressing cracks in the taut material.

According to a further development, for holding fast purposes, a web section is pressed, whilst building up static or sliding friction, onto a pressure surface moving in the feed direction. Compared with an also possible, substantially punctiform or linear retention, the resulting large-area retention on a pressure surface of e.g. one or more square centimeters requires little force for a reliable hold. As a result of the areal application of the holding force, there is a reliable avoidance of material damage to the web material, which could lead to unintentional tears. It is particularly preferred if, for retaining a web section, between the latter and the pressure surface a vacuum is produced. A web section is so-to-speak held from below, whilst the side remote from the pressure surface remains free from holding means, so that a particularly large amount of space can be created for the application of a suitable separating device. A pressure surface can in particular be formed by an outer surface of a rotating conveying member of a suction conveyor, e.g. a suction belt, particularly a suction roller.

Disposal can include a step of collecting separated material pieces following the separating operation. Preference is given to a method in which, following separation, the web material pieces are detached from a moving pressure surface carrying and/or retaining the same. This can e.g. take place with contact by means of a spatula, doctor blade, etc., but is preferably performed in contactless manner by means of at least one air flow, which raises the web material portions from the pressure surface, particularly by suction. Blowing and sucking off can also be used in combination for separating purposes.

As a result of the continuous breaking down into pieces of the web material a space-saving packing of the used material is assisted, because no material pieces with higher packing densities have to be stored. The packing density can preferably be increased in that the collected web material pieces are compressed, preferably batchwise, e.g. to less than ½, ¼ or ⅛ of the packing volume in the looser, uncompressed state. The waste e.g. compacted in a baling press can subsequently be stored in space-saving manner and/or transported away.

The invention permits a continuous disposal of used web material and in particular even in the case of thin films this takes place in a troublefree manner, so that stoppages resulting from disposal can be avoided and correspondingly the throughput capacity of the web material processing equipment can be increased.

A disposal apparatus suitable for performing the method has first holding means for the flat or areal holding fast of a first web section, second holding means for the flat or areal holding fast of a second web section, which is preferably laterally spaced from the first web section, and at least one separating device cooperating with the holding means for the separation of the web material in an intermediate or separating section located between the web sections.

Advantageously the first holding means and/or the second holding means have at least one pressure surface movable in the feed direction and onto which the web sections can be pressed flat. In particular, the holding means can be formed by a continuous, revolving conveying means, such as a conveyor belt or feed roller, on which a longitudinal section of the web material rests flat. It is possible for the pressure surface to be moved with the feed web speed, so that static friction can build up between the web material and the pressure surface. It is also possible to move the pressure surface at a higher speed or excess speed compared with the supplied material, so that slip occurs between the pressure surface and the material web, accompanied by the building up of sliding friction.

Pressure can be applied from the side opposite to the pressure surface, e.g. in material-protecting manner using brushes or the like. In a preferred embodiment the holding means are formed by a suction conveyor, particularly a suction roller, which has at least one conveying element rotating at the feed speed or a circumferential speed higher than the feed speed and having an outer surface serving as the pressure surface, onto which can be sucked a longitudinal web material section incorporating the web sections and the intermediate or separating section.

Although it is possible for an associated separating device to come into cutting engagement e.g. with the pressure surface, it is preferable for said pressure surface to have at least one recess, preferably running transversely to the movement direction and bridgeable or spannable by the web material. In the vicinity of the recess a section of the pressed on web material can be held in freely suspended and/or taut manner without contact with the substrate, which aids a reliable separation in this area.

A separating device preferably has at least one movable separating member controlled in such a way that it separates the moving web material in the vicinity of the recess bridged by the web material in freely suspended manner. In particular, the separating device can have at least one rotary member synchronized with the rotating conveying means and carrying on its circumference at least one separating member preferably oriented transversely to the circumferential direction and which is so positioned with respect to the conveying means, that a separating member meshes or engages in an associated recess. As a result of the separating member the web material freely suspended and optionally taut in the vicinity of the recess can be reliably and completely separated. A construction particularly suitable for cutting stamping film webs or other plastic films is characterized in that the separating member is a cutting blade, particularly having a serrated edge, through which punctiform perforations are initially formed even in the case of limited pressure action when the separating member engages in the web material and which, optionally assisted by the inherent tension of the web material, during further penetration of the cutting member are enlarged and finally coalesce so as to form a through cut.

Further features and details of the invention can be gathered from the following description of a preferred embodiment in conjunction with the drawing and subclaims. The individual features, either singly or in the form of combinations, can be implemented in an embodiment.

DETAILED DESCRIPTION OF THE DRAWING

Figure 1:
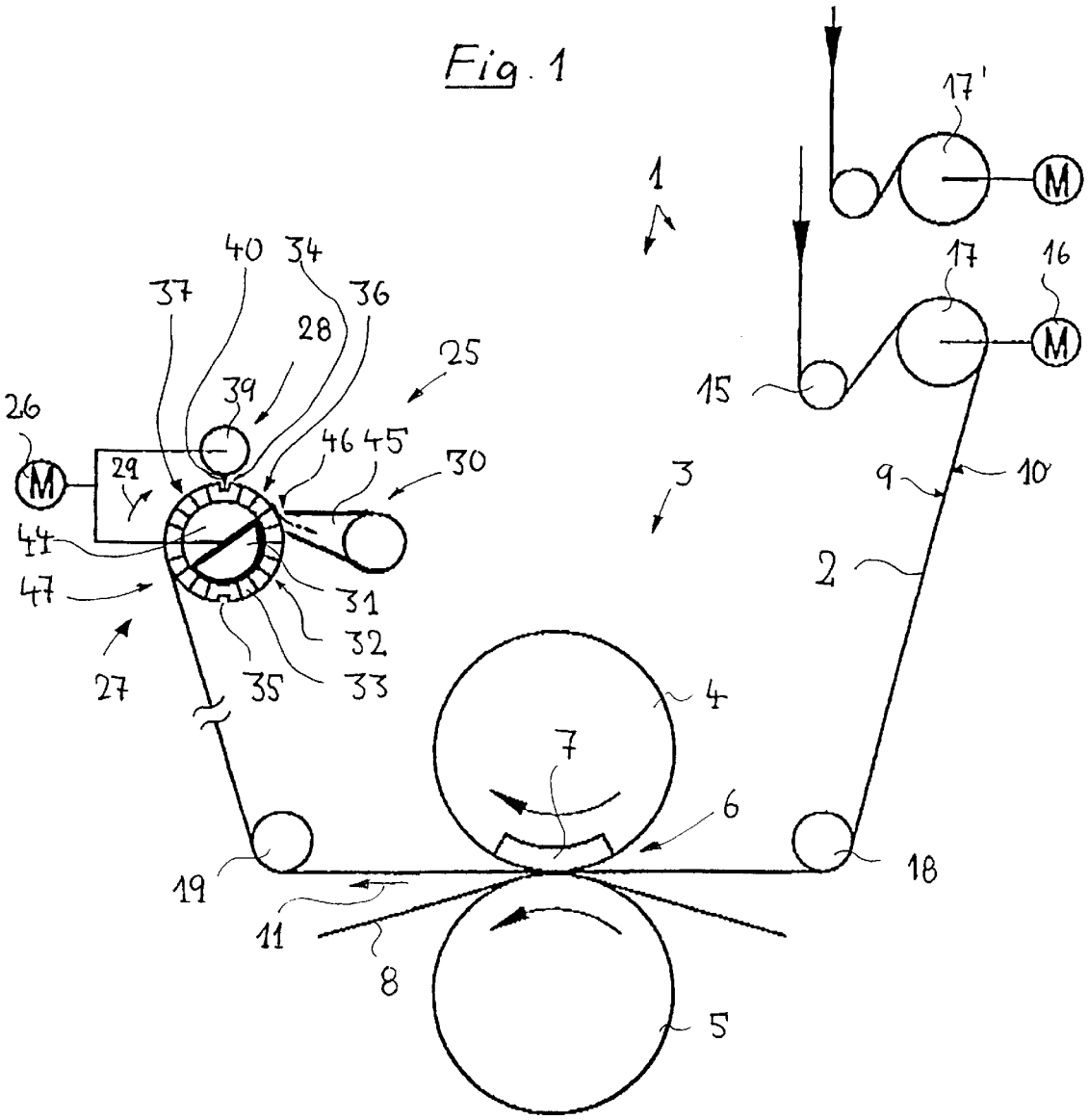
FIG. 1 is a diagram of the side view of a rotary stamping machine with an inventive, continuously operating disposal apparatus.

FIG. 1 diagrammatically shows some elements of a conveying mechanism 1 for conveying a stamping film web 2 into a rotary hot stamping machine. The latter is e.g. used for stamping successive sheets or a web of paper, cardboard or plastic. It has a stamping press 3 with a horizontal stamping cylinder 4 and an underlying impression cylinder 5 of roughly the same size and between which is formed a stamping gap 6. Along its circumference, the stamping cylinder 4 has at least one heatable stamping die 7, through which on the material layer 8 passing at a uniform web speed through the stamping gap 6 a stamping unit located on the stamping film web 2 is stamped. The stamping film web 2 has a back 9 and a sensitive front 10, which carries a hot-melt adhesive coating and during a stamping interval shown in the drawing runs at the same speed and with the same movement direction 11 through the stamping gap 6, so that under the influence of pressure and temperature the stamping unit is transferred to the material layer.

With regards to the construction of the film conveying mechanism 1, the apparatus can correspond to the rotary machine described in EP 718 099, whose relevant features are made by reference into subject matter of the present application. Starting from a not shown wind-off storage roll serving as a film supply, a stamping film web is guided through a film loop store, via a guide roller 15 to a control roller 17 controllable by a drive motor 16 and which is followed by a guide roller 18 guiding the stamping film web to the stamping gap 6. On the feed side is indicated a further control roller 17', which is constructed for the simultaneous processing of several, preferably independently controllable and parallel stamping film webs. The control roller 17 is constructed as a suction roller and is controllable with respect to the rotation direction and/or rotation speed and controls the extent and direction of the film web movement through the stamping gap. It cooperates with a pulling or drawing device (not shown) which follows the guide roller 19 following the stamping gap 6 and which serves to maintain a suitable stamping film web tension in the stamping gap area, as well as during the further conveying of the used stamping film web. The latter is guided by a further, not shown film loop store to a continuously functioning disposal device 25. In this embodiment the web speed with which the film web leaves the film store corresponds to the feed web speed with which the material is fed to the disposal device 25.

The disposal device 25 incorporates a transfer roller 27 driven by means of a speed-controllable motor 26, a separating device 28 cooperating therewith, as well as a suction device 30 directed onto the suction roller circumference and following the separating device 28 in the suction roller rotation direction 29.

The transfer roller 27 is constructed as a vacuum or suction roller. It has a fixed roller core 31 around which rotates a roller sleeve 33 provided along its circumference with radial, through openings 32. The roller core 31 is constructed in the form of a cylindrical segment and has a semi-cylindrical recess 44 open to the imaginary edge of the cylinder. The roller core and roller sleeve are so sealed against one another, that the cavity formed in the vicinity of the recess is only open to the cylindrically curved outer face of the roller or the environment in the vicinity of the openings 32 adjacent thereto. In this are a covering roughly 180° the suction roller 27 is looped by the stamping film web 2 coming from the guide roller 19 and running to the suction device 30.

On the circumference of the roller sleeve 33 are provided two slat-like recesses 34, 35 parallel to the rotation axis or perpendicular to the rotation direction 29 and diametrically facing with respect to the roller rotation axis. It is also possible to have only a single recess or more than two recesses preferably arranged at regular intervals in the circumferential direction. The diagrammatically shown recesses have in the circumferential direction a width of approximately 0.5 cm and in each case pass over the entire width of the roller sleeve and in each case separate a front section 36 in the rotation direction of the cylindrical surface of the roller from a spaced, following, rear section 37. In the stamping film web feed direction, the sections 36, 37 form movable, cylindrically curved pressure surfaces, onto which can be pressed the web sections resting thereon with the suction blower operating and accompanied by the building up of static friction, in that between the suction roller surface and the web material a vacuum is produced in the vicinity of the recess 44. Thus, in the vicinity of the front section 36 are formed first holding means and in the vicinity of the rear section 37 second holding means for holding fast in large-area manner a resting stamping film web. An intermediate or separating section spanning the recess 34 and located between the sections 36, 37 is freely suspended over the bottom of the recess 34 and can, if there is at least one suction opening in the vicinity of the recess, accompanied by the building up of web tension, be slightly sucked into the vicinity of the recess 34, preferably without contacting the bottom.

The separating device 28 cooperating with the suction roller 27 has a roller-like rotary member 39 rotating in synchronized manner with the roller sleeve 33 and driven by the motor 26 and on whose circumference is arranged a separating member 40 oriented transversely to the circumferential direction in the form of a knife having a serrated, radially outwardly projecting blade. The suction roller 27 and rotating knife support 39 of the separating device are so mutually arranged and driven in synchronized manner that during each rotation of the roller the separating member 40 alternately engages in one of the recesses 34, 35 roughly centrally between the edges thereof, but without coming into contact with the bottom of the recess.

The suction device 30 has a suction nozzle 45 connected to a not shown suction fan and whose suction opening 46 facing the suction roller 27 is located with a slight radial spacing with respect to the circumferential surface of the roller sleeve 33 in a circumferential area of the roller, in which the suction openings 32 from the recess 44 enter the area of the roller core 31 covering the openings. In this area as a result of the sealing of the suction openings the vacuum-caused retention force is set aside, so that it is possible to ensure a slight raising of the web material still resting on the circumferential surface and optionally still adhering thereto. It is alternatively or additionally possible to supply compressed air from the inside to the openings 32 in the area facing the suction opening 46, so that an active blowing off of the web material portions assists suction. The conveyed away, comminuted web material can, after suction, be conveyed by a suitable air flow into a collecting tank. Preferably, following on the collection of the waste, there is an either continuous or batchwise compression for further reducing the packing volume, e.g. using a baling press.

The apparatus can operate according to the following method. Prior to the starting up of the stamping mechanism, a free end portion of the stamping film web is guided through the stamping gap and round the guide roller 19, etc. until it is on the part of the suction roller 27 provided with active suction openings, where the free end portion is securely held by vacuum. With the apparatus running and the roller sleeve rotating in direction 29, continuously supplied web material is drawn in and passes on the circumferential portion 37 upstream of the separating device 28 into areal adhesive contact with the circumferential surface of the sleeve. In the embodiment shown the circumferential sleeve surface speed corresponds to the feed web speed of the film web 2, so that accompanied by the building up of static friction and without sliding, the latter is carried along or is drawn by the suction roller 27 out of the upstream film store. As soon as a recess enters the engagement area 47, in which the tangentially arriving stamping film web comes into contact with the roller, the recess is bridged by the taut stamping film web. The bridged area continues to run in the direction of the separating device 28, whilst the film web is drawn onto the holding section following the recess.

The serrated edge of the revolving cutting member 40 runs on a circular path which, in the vicinity of the connecting line between the rotation axes of the suction roller 27 and the rotary member 29 overlaps with the cylindrical circumferential surface of the suction roller. When a spanned recess enters the area of the separating device, the separating member is firstly engaged on the outside of the taut film and on further rotation into the position shown in FIG. 1 in which the blade is directed directly towards the rotation axis of the suction roller, continues to press into the interior of the recess. Beyond the indicated position of maximum penetration depth, the separating member as a result of the contrarotation of the rotary members 27, 39 passes out of the area of the recess again.

On placing the serrated knife 40 on the film, in the area of the quasi-punctiform serration tips arranged along a straight line perpendicular to the rotary direction 29 immediately high contact pressures are reached, which bring about a punctiform perforation of the film in the transverse direction, without pressing strongly into the recess. The large-area adhesion of the film web on either side of the recess reliably prevents web material being drawn into the vicinity of the recess during the separating process. As the separating process progresses the sawteeth penetrate further into the recess accompanied by the widening of the perforations until the latter finally coalesce and the part of the material web adhering flat to the front section 36 located upstream of the recess in the rotary direction is detached from the section adhering to the rear pressure surface 37. The web material piece which is then no longer connected with the remainder of the stamping film web, on further rotation, passes with its front area into the vicinity of the suction opening 46. Simultaneously the suction openings covered by the front section are internally covered by the roller core 31, so that the suction action stops and the material piece can easily be sucked off.

In a not shown embodiment constructed for producing longitudinal cuts, the conveying member formed in the described embodiment by the suction roller 27 can have along its circumference one and preferably several, parallel circumferential recesses, in the vicinity of which can engage fixed or also rotating separating members, such as knives, in order to separate the material web into narrow, longitudinal strips. The longitudinal cut can be combined with transverse separations, in order to produce short web chips, which can be collected and optionally compacted with a particularly high packing density.

Whereas in the described embodiment the circumferential speed of the suction roller 27 is the same as the feed web speed, in another, not shown embodiment the circumferential speed of a revolving conveying member is at least temporarily, but preferably continuously higher than the feed web speed, so that between the material web and the corresponding pressure surfaces no static friction occurs and instead sliding friction is built up or slip occurs. As a result the conveying member of the disposal apparatus pulls gently and in jerk-free, but constant manner on the supplied web material. It is optionally also possible for the web material to be drawn back briefly towards the stamping gap counter to the conveying member rotation direction. The length of the pressure surface in the circumferential direction can appropriately be chose in such a way that a complete sliding or drawing of the material web from the conveying member is reliably prevented. Such a conveying device of the disposal apparatus can cooperate with a cross and/or longitudinal cut separating device. Use can be made with particular advantage of longitudinal cutters, whose fixed or moving, particularly rotating separating members bring about a separation of the web material largely independently of the in each case prevailing web speed of the web material supplied to the same. In the case of cross-cutters, in a variant of the described embodiment, it can e.g. be the case that a rotating separating member rotates with a speed diverging from the circumferential speed of the suction conveyor and which can optionally be controlled as a function of the actual feed web speed, so as to prevent or minimize tearing or plucking on the web material to be separated.

A conveyor particularly suction conveyor, rotating at an excess speed compared with the moving film web, of the disposal apparatus can form a pulling device with a slip drive for the material web 2, which cooperates with the control roller 17 upstream of the stamping gap for the continuous or discontinuous movement of the stamping film web through said gap. Thus, optionally a separate pulling device, such as is e.g. formed by the suction conveyor with slip drive of EP 718 099 can be rendered superfluous. There may also be no need for a film store optionally positionable between the stamping gap and the disposal apparatus. In such an embodiment a suction conveyor can have a double function, in that on the one hand within the scope of the film acceleration means it ensures the correct movement speed and optionally direction of the stamping film web in the stamping gap and on the other it acts as a holding means for the used stamping film web during continuous disposal.

Disposal apparatuses according to the invention also operate reliably at high web material throughput rates and are eminently suitable both for the separation of thicker, stiffer web material, such as paper or the like, but in particular for the reliable chopping into pieces of thin film material. The resulting possibility of a troublefree, continuous disposal of used web material makes it possible to operate corresponding devices for the processing of the web material without disposal-caused shutdown times in order to achieve a higher output.

What is claimed is:

1. Method for the disposal of flexible material in the form of at least one moving material web, the material web being supplied in a feed direction with a feed web speed to a disposal apparatus, the method comprising the following steps:

holding fast a first web section of the material web the second web section being spaced from the first web section;

holding fast a second web section of the material web;

separation of the material web in an intermediate section located between the first web section and the second web section.

2. Method according to claim 1, wherein the web material is held in a freely suspended manner in the intermediate section.

3. Method according to claim 1, wherein the web material is held in a taut manner in the intermediate section.

4. Method according to claim 1, wherein, when viewed in the feed direction, the first web section is located upstream and the second web section is located downstream of the intermediate section and wherein separation takes place transversely to the feed direction.

5. Method according to claim 1, wherein, when viewed in the feed direction, the first web section is at least zonely located alongside the second web section and wherein separation takes place in a direction which is directed one of at an acute angle and substantially parallel to the feed direction.

6. Method according to claim 5, wherein separation takes place simultaneously at several spaced apart points in the intermediate section.

7. Method according to claim 1, wherein the material web in the intermediate section is cut with a free blade for separation purposes.

8. Method according to claim 1, wherein during separation the material web is perforated in the intermediate section at numerous points to create spaced apart perforations and wherein perforations are subsequently enlarged until they coalesce.

9. Method according to claim 1, wherein in the separation step the material web is melted in the intermediate section.

10. Method according to claim 9, wherein the material web in the intermediate section is melted along a substantially straight melt line.

11. Method according to claim 1, wherein the step of holding fast a web section of the material web includes a flat retention of at least one web section on a pressure surface moving in the feed direction by pressing the web section onto the pressure surface such that at least one of static friction and sliding friction is generated.

12. Method according to claim 11, wherein the pressing of the web section on the pressure surface includes a generation of a vacuum between the pressure surface and the web section.

13. Method according to claim 1, further comprising the step of collecting separated web material pieces after separation of the material web.

14. Method according to claim 13, wherein the separated web material pieces are carried on a moving substrate and wherein for collecting the web material pieces are detached from the moving substrate.

15. Method according to claim 14, wherein the step of detaching of the web material pieces from the moving substrate includes at least one of the steps of detaching the web material pieces by means of an airflow and by suctioning off the web material pieces from the moving substrate.

16. Method according to claim 13, wherein during the collection, collected web material pieces are compressed.

17. Disposal apparatus for the disposal of flexible material in the form of at least one moving material web, the material web being supplied in a feed direction with a feed web speed to the disposal apparatus, the disposal apparatus comprising: first holding means for the retention of a first web section of the material web in a retention area;

second holding means for the retention of a second web section of the material web in a retention area, the first holding means being spaced apart from the second holding means;

a separating device cooperating with the holding means for separating of the material web in an intermediate mediate section located between the first web section and the second web section.

18. Disposal apparatus according to claim 17, wherein at least one of the first holding means and the second holding means comprise at least one pressure surface movable in the feed direction for pressing a web section on the pressure surface such that at least one of static friction and sliding friction is build up between the pressure surface and the web section pressed on the pressure surface.

19. Disposal apparatus according to claim 17, wherein at least one of the first and second holding means comprises at least one continuously revolving conveying means providing a pressure surface movable in the feed direction.

20. Disposal apparatus according to claim 19, wherein the conveying means comprises at least one of at least one transfer roller and at least one conveyor belt.

21. Disposal apparatus according to claim 18, wherein at least one of the first and second holding means comprises at least one suction conveyor comprising at least one revolving conveying member providing an outer surface, the outer surface being designed such that a longitudinal portion of the material web incorporating the first and second web sections and the intermediate section can be sucked onto the outer surface.

22. Disposal apparatus according to claim 18, wherein the pressure surface comprises pressure surface portions separated by at least one recess which can be bridged by a section of the material web pressed on the pressure surface portions adjacent to the recess such that the material web is suspended freely across the recess.

23. Disposal apparatus according to claim 22, wherein the recess is oriented transversely to the movement direction of the pressure surface.

24. Disposal apparatus according to claim 22, wherein the pressure surface is provided on a revolving conveying means and wherein the revolving conveying means comprises several circumferentially displaced recesses.

25. Disposal apparatus according to claim 17, wherein the separating device comprises at least one movable separating member and wherein the holding means comprise at least one pressure surface movable in the feed direction and provided with at least one recess bridgeable by the material web pressed on the pressure surface and wherein the movable separating member is controllable in such a way that it separates the moving material in an intermediate portion bridging the recess.

26. Disposal apparatus according to claim 17, wherein the separating device comprises at least one rotary member provided at its circumference with at least one separating member rotating with the rotary member; wherein the holding means comprise at least one revolving conveying means provided with an outer surface serving as a pressure surface onto which the material web can be pressed, wherein the outer surface comprises at least one recess bridgeable by the material web pressed onto the pressure surface and wherein the revolving conveying means is so positioned relative to the conveying means that the separating member meshes with the recess upon rotation of the rotary member and the separating member.

27. Disposal apparatus according to claim 25, wherein the separating member is a knife.

28. Apparatus according to claim 27, wherein the knife has a serrated blade.

29. Disposal apparatus according to claim 17, further comprising a collecting device for collecting separated web material pieces generated by the separating device.

30. Disposal apparatus according to claim 29, wherein the collecting device comprises a suction device for collecting the web material pieces by suctioning.

31. Disposal apparatus according to claim 29, further comprising a compression device for compressioning of the web material pieces collected by the collecting device.

32. Disposal apparatus according to claim 31, wherein the compression device is constructed as a baling press for batchwise compression of the collected web material pieces.

33. Disposal apparatus according to claim 17, wherein the material web is a used stamping film web used by a stamping device for stamping articles provided on the stamping film onto a material layer to be stamped using a stamping device.

34. stamping device comprising a stamping press provided with a stamping cylinder and an impression element wherein between the stamping cylinder and the impression element is formed a stamping gap, further comprising a conveying device for conveying the stamping film web through the stamping gap, wherein at least one disposal apparatus for the disposal of the used stamping film web is provided downstream of the stamping gap, the stamping film web being supplied in a feed direction with a feed web speed to the disposal apparatus, the disposal apparatus comprising:

first holding means for the retention of a first web section of the material web in a retention area;

the second holding means for the areal retention of a second web section of the material web in a retention area, the first holding means being spaced apart from the second holding means;

a separating device cooperating with the holding means for separating of the material web in an intermediate section located between the first web section and the second web section.

* * * * *